United States Patent [19]

Izuta

[11] Patent Number: 4,936,283

[45] Date of Patent: Jun. 26, 1990

[54] ARCHERY STABILIZER

[75] Inventor: Tadao Izuta, Hamamatsu, Japan

[73] Assignee: Yamaha Corporation, Japan

[21] Appl. No.: 325,237

[22] Filed: Mar. 17, 1989

[30] Foreign Application Priority Data

Mar. 18, 1988 [JP] Japan ..... 63-64947

[51] Int. Cl.[5] ..... F41B 5/00

[52] U.S. Cl. ..... 124/89

[58] Field of Search ..... 124/23 R, 24 R, 86, 124/88, 89; 188/378–380

[56] References Cited

U.S. PATENT DOCUMENTS

| | | | |
|---|---|---|---|
| 3,412,725 | 11/1968 | Hoyt | 124/89 X |
| 3,524,441 | 8/1970 | Jeffery | 124/89 X |
| 3,589,350 | 6/1971 | Hoyt et al. | 124/89 X |
| 3,628,520 | 12/1971 | Izuta | 124/89 X |
| 4,135,486 | 1/1978 | Enomoto | 124/89 |
| 4,615,327 | 10/1986 | Saunders | 124/89 |

FOREIGN PATENT DOCUMENTS

| | | | |
|---|---|---|---|
| 2538490 | 3/1977 | Fed. Rep. of Germany | 124/89 |
| 145399 | 12/1978 | Japan | 124/89 |

*Primary Examiner*—Randolph A. Reese
*Assistant Examiner*—John A. Ricci
*Attorney, Agent, or Firm*—Lerner, David, Littenberg, Krumholz & Mentlik

[57] ABSTRACT

In an archery stabilizer in which the proximal end of a swing rod carrying a damper head is held by a damper unit for detachable mounting to an archery bow, the proximal end of the swing rod is totally embraced by an elastic piece and a bearing in the damper unit so that the swing rod may undergo elastic deformation upon the release of an arrow from the bow. By totally embracing the proximal end of the swing rod, the damper unit enhances the damping ability of the stabilizer without necessitating an increase the size and weight of the stabilizer.

5 Claims, 3 Drawing Sheets

ARCHERY STABILIZER

BACKGROUND OF THE INVENTION

The present invention relates to an archery stabilizer, and in particular to improvements in the weight and damping ability of an archery bow equipped with one or more stabilizers.

It is well know that in shooting an arrow by an archery bow, the arrow behaves in a manner which is generally known as "an archery paradox". That is, in the drawn position the shaft of the arrow is strongly pressed near its tip against the wall of the sight window of the bow so that it flexes convexly with respect to the grip. In reaction to being released from the drawing position, the shaft of the arrow undergoes a secondary flexion which is concave with respect to the grip. Thereafter, the arrow advances while alternately flexing in these opposing directions.

For the arrow to fly smoothly and accurately in the intended direction, the bow must exhibit a delicate reaction in response to the above-described initial behavior of the arrow. Should the bow not react, the arrow will flex alternately and, hence, will be unable to achieve a stable, accurate flight.

In order to avoid this difficulty, it has been proposed to attach a stabilizer to each limb of an archery bow. The attachment of such stabilizers increases the moment of inertia of the bow, so that the bow exhibits a delicate reaction in response to the initial behavior of an arrow as it is released. Such increased moment of inertia enables the vibration of the bow caused by tremors of the archer and movement of the stabilizer swing rods to be absorbed.

In a common construction of a conventional stabilizer, a relatively heavy damper head is attached to the distal end of a swing rod and the proximal end of the swing rod is attached to one limb of an archery bow via a damper unit. The damper unit includes a hollow, cylindrical housing closed at one end and a threaded shaft fixed to the closed end and adapted for screw engagement with the handle of the bow. A first elastic piece made, for example, of rubber is tightly fit into the cylindrical housing. A rod carrier inserted into the cylindrical housing in contact with the first elastic piece is embraced by a second elastic piece. Finally, a fastener ring is placed in screw engagement with the open end of the cylindrical housing. The proximate end of the swing rod is inserted idly through the fastener ring and into axial screw engagement with the rod carrier. By adjusting the position of the fastener ring on the cylindrical housing, the degree to which the first and second elastic pieces are compressed may be altered, thereby enabling control of the swing amplitude of the swing rod and associated damper head.

In the construction of conventional stabilizers discussed above, the weight of the swing rod and associated damper head is borne only by the end-to-end contact of the rod carrier with the first elastic piece, the swing rod being allowed to move with the rod carrier. Consequently, the swing rod has very poor damping ability. In order to overcome this disadvantage, an increased area of contact must be provided between the rod carrier and the first elastic piece. This inevitably leads to a damper unit having an enlarged size and, therefore, the total weight of the archery stabilizer is increased. Such an increased total weight prevents the archery bow from having a wide range of moment of inertia. In addition, such an increased total weight induces early fatigue in the archer's arm upon prolonged play, thereby preventing proper control during shooting.

SUMMARY OF THE INVENTION

In accordance with the present invention, the proximal end of a swing rod carrying a damper head is totally embraced by an elastic piece and a bearing within the cylindrical housing of the damper unit.

DESCRIPTION OF THE PREFERRED EMBODIMENTS

Figure 1:
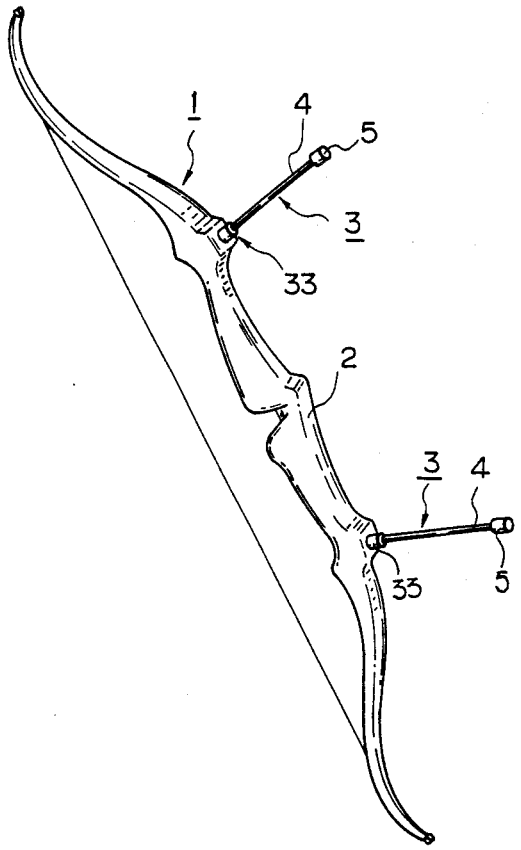
FIG. 1 is a perspective view of an archery bow equipped with the improved stabilizers in accordance with the present invention.

FIG. 1 shows an entire view of an archery bow 1 provided with the stabilizers 3 in accordance with the present invention. Like conventional stabilizers, stabilizers 3 are attached to the handle 2 of the bow 1 via damper units 33, each stabilizer 3 including a swing rod 4 carrying a damper head 5.

Figure 2:
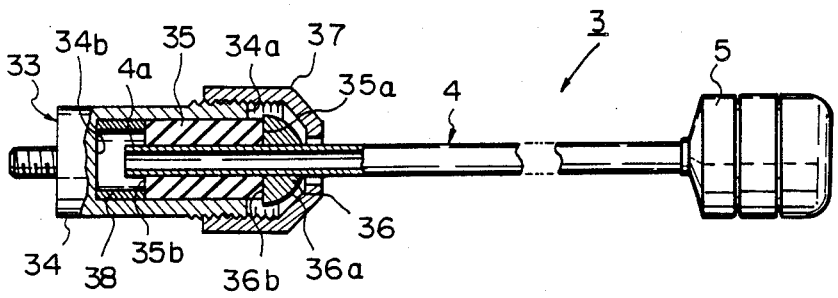
FIG. 2 is a side view of one stabilizer shown in FIG. 1; showing the damping unit in partial cross-section.

As shown in FIG. 2, one embodiment of the stabilizer 3 in accordance with the present invention includes a swing rod 4 carrying at its distal end a damper head 5. Preferably, the swing rod 4 has a hollow, cylindrical shaft made of fiber reinforced plastic capable of achieving a wide range of elastic deformation to thereby provide a high damping ability.

The stabilizer 3 further includes a damper unit 33 coupled to the proximal end of the swing rod 4 in a manner described in more detail below. The damper unit 33 has a hollow, cylindrical housing 34 open at one end **34*a*. An elastic piece 35, preferably formed from rubber, is tightly fit into the cylindrical housing 34. The proximal end 4*a* of the swing rod 4 is axially inserted through the elastic piece 35 to form a tight connection. A bearing 36 is fixedly inserted over the swing rod 4 near the open end 34*a* of the cylindrical housing 34. Bearing 36 has a hemispherical end 36*a* which faces the damper head 5, and a flat end 36*b* which is kept in pressure contact with one end 35*a* of the elastic piece 35. A fastener ring 37, in screw engagement with the open end 34*a* of the cylindrical housing 34, spacedly covers the bearing 36 with swing rod 4 idly and axially passing through the fastener ring 37. By altering its position on the cylindrical housing 34, fastener ring 37 adjusts the degree of pressure contact between the bearing 36 and the elastic piece 35. A spacer ring 38 is arranged between the closed end 34*b* of the cylindrical housing 34 and the other end 35*b* of the elastic piece 35. By using spacer rings of different length, different swing amplitudes of the swing rod 4** may be obtained.

Figure 3A:
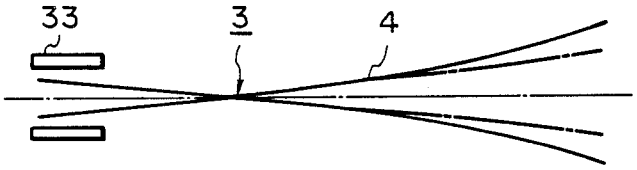
FIGS. 3A and 3B schematically show the behavior of the swing rod of the stabilizer in accordance with the present invention at the point at which an arrow is released.
Figure 3B:
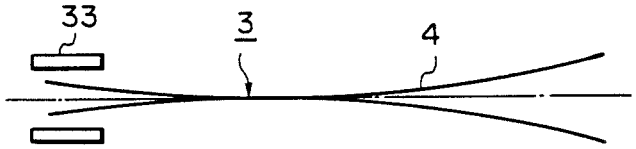

The operation of stabilizer 3 having the aforementioned construction is as follows. As shown in FIGS. 3A and 3B, the swing rod 4 of the stabilizer 3 elastically deforms to effectively damp the undesirable vibration of the archery bow 1 as an arrow is released therefrom. The damping effect results from the particular construction of the damper unit 33 wherein the proximal end of the swing rod 4 is totally embraced by the bearing 36 and the elastic piece 35. By totally embracing the proximal end of the swing rod 4 in this manner, the swing rod may elastically deform upon the release of an arrow, thereby providing a high degree of damping without the need for an increase in the size of the damper unit 33. Thus, the total weight of the archery stabilizer 3 is minimized, thereby enabling a wide range of moment of inertia to be achieved. In addition, the small total weight of the archery stabilizer 3 prevents the archer's arm from fatiguing prematurely so that maximum control may be maintained over a long period of time.

Figure 4:
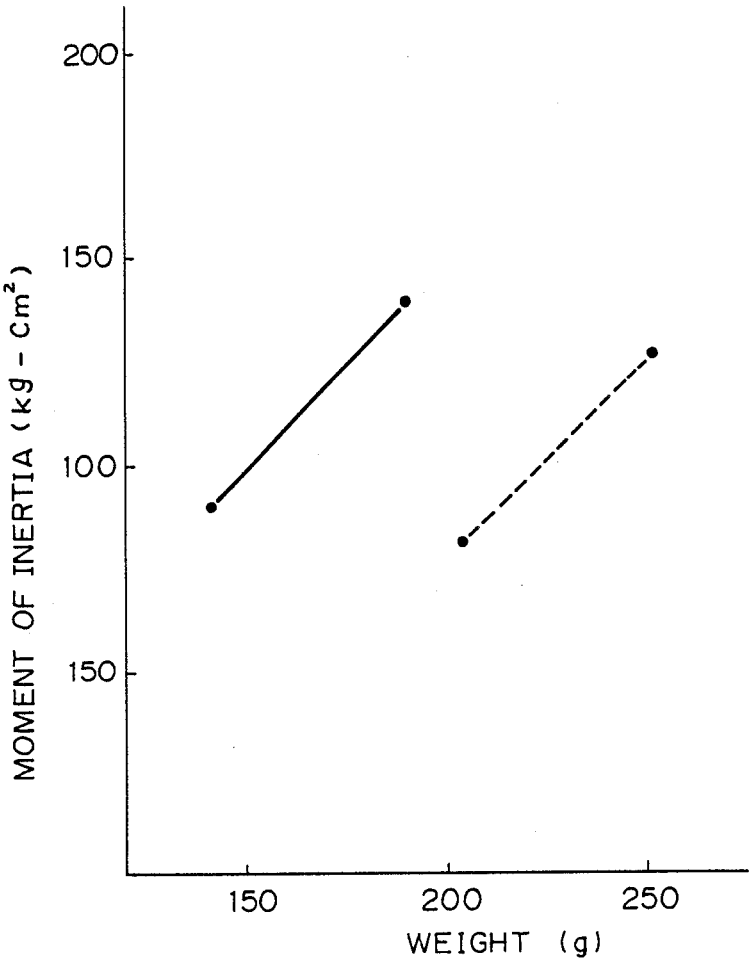
FIG. 4 is a graph indicating the relationship between the weight and the moment of inertia of an archery stabilizer.

The damping ability of an archery stabilizer is commonly expressed in numerical terms by the amount of moment of inertia provided per unit weight. In FIG. 4, the moment of inertia (kg-cm$^2$) is plotted on the ordinate and the weight (g) of the stabilizer is plotted on the abscissa. The curve for a conventional stabilizer is shown by the dotted line, while the curve for the stabilizer in accordance with the present invention is shown by the solid line. In order to obtain a moment of inertia per unit weight in the range from 80 kg-cm$^2$ to 130 kg-cm$^2$, a conventional stabilizer needs to have a weight of about 200 g to 250 g. On the other hand, the stabilizer in accordance with the present invention need only have a weight of about 150 g to 200 g to obtain a moment of inertia per unit weight in approximately the same range.

Further adjustment in damping ability may be achieved by utilizing a different spacer ring 38 and/or changing the position of the fastener ring 37 on the cylindrical housing 34.

I claim:

1. A stabilizer for an archery bow comprising:

a swing rod having a proximal end and a distal end, a damper head connected to said distal end of said swing rod, and a damper unit holding said proximal end of said swing rod for detachable connection to said archery bow, said damper unit including a hollow, cylindrical housing having a closed end and an open end to accommodate said proximal end of said swing rod, a cylindrical elastic piece tightly inserted into said cylindrical housing to totally and directly embrace said proximal end of said swing rod, a bearing inserted over said proximal end of said swing rod in pressure contact with one end of said elastic piece, and a fastener ring coupled to said open end of said cylindrical housing to cover said bearing and said elastic piece, said bearing having a hemispherically shaped end adjacent said fastener ring to provide uniform pressure distribution in the contact between said bearing and said elastic piece.

2. A stabilizer for an archery bow as claimed in claim 1 wherein said damper unit further includes a spacer ring interposed between said closed end of said cylindrical housing and another end of said elastic piece.

3. A stabilizer for an archery bow as claimed in claim 2 wherein said fastener ring is coupled to said cylindrical housing via screw engagement.

4. A stabilizer for an archery bow comprising, a swing rod having a proximal end and a distal end, a damper head connected to said distal end of said swing rod, a damper unit holding said proximal end of said swing rod for detachable connection to said archery bow, said damper unit including a hollow, cylindrical housing having a closed end and an open end to accommodate said proximal end of said swing rod, a cylindrical elastic piece tightly inserted into said cylindrical housing to totally and directly embrace said proximal end of said swing rod, a bearing inserted over said proximal end of said swing rod in pressure contact with one end of said elastic piece, a spacer ring interposed between said closed end of said cylindrical housing and another end of said elastic piece, and a fastener ring coupled to said open end of said cylindrical housing to cover said bearing and said elastic piece.

5. A stabilizer for an archery bow as claimed in claim 4 wherein said fastener ring is coupled to said cylindrical housing via screw engagement.

* * * * *